US005855522A

United States Patent [19]

Bevan

[11] Patent Number: 5,855,522

[45] Date of Patent: Jan. 5, 1999

[54] GOLF PUTTING APPARATUS WITH VARIABLE SURFACE

[76] Inventor: Paul C. Bevan, 60 Tisdale Dr., Dover, Mass. 02030

[21] Appl. No.: 966,950

[22] Filed: Nov. 10, 1997

[51] Int. Cl.[6] ..... A63B 69/36

[52] U.S. Cl. ..... 473/160

[58] Field of Search ..... 473/157–163

[56] References Cited

U.S. PATENT DOCUMENTS

| | | | |
|---|---|---|---|
| 1,582,183 | 4/1926 | Maurer . | |
| 1,612,291 | 12/1926 | Jackson | 473/160 |
| 1,662,864 | 4/1928 | Peterson . | |
| 1,761,039 | 6/1930 | Hazeltine . | |
| 2,118,084 | 5/1938 | Heinzelmann | 273/87 |
| 2,334,540 | 11/1943 | Buffham | 273/35 |
| 2,678,823 | 5/1954 | Hugman | 273/35 |
| 3,170,694 | 2/1965 | Dolce | 273/115 |
| 3,366,388 | 1/1968 | Del Roso | 273/176 |
| 3,508,756 | 4/1970 | Bedford, Jr. | 273/176 |
| 3,522,947 | 8/1970 | Anderson et al. | 473/161 |
| 3,549,151 | 12/1970 | Long | 273/178 |
| 3,595,581 | 7/1971 | Anderson | 273/176 H |
| 3,601,407 | 8/1971 | Lorrance | 273/176 H |
| 3,658,343 | 4/1972 | Rogers et al. | 273/176 H |
| 3,690,673 | 9/1972 | Occhipinti | 273/176 H |
| 3,727,917 | 4/1973 | MacLean | 273/176 H |
| 3,762,718 | 10/1973 | Culley | 273/176 H |
| 3,871,661 | 3/1975 | Korff | 273/178 B |
| 3,892,412 | 7/1975 | Koo | 273/176 H |
| 3,909,006 | 9/1975 | Arbaugh | 273/176 AA |
| 3,944,232 | 3/1976 | Tierney | 273/176 FB |
| 4,211,417 | 7/1980 | Brown | 273/176 H |
| 4,222,568 | 9/1980 | Russo | 273/176 H |
| 4,240,637 | 12/1980 | Cross et al. | 273/176 H |
| 4,247,112 | 1/1981 | Del Raso | 273/176 H |
| 4,596,391 | 6/1986 | Carolan, Jr. | 273/176 B |
| 4,611,809 | 9/1986 | Gettelfinger | 273/176 H |
| 4,743,027 | 5/1988 | Simjian | 273/178 R |
| 4,790,538 | 12/1988 | Gettelfinger | 273/176 H |
| 4,988,106 | 1/1991 | Coonrod | 273/176 F |
| 5,002,280 | 3/1991 | Hines | 273/176 FB |
| 5,087,045 | 2/1992 | Kim | 273/176 H |
| 5,102,141 | 4/1992 | Jordan | 273/182 R |
| 5,172,914 | 12/1992 | Primerano | 273/176 H |
| 5,213,325 | 5/1993 | Malavazos, et al. | 273/110 |
| 5,318,303 | 6/1994 | Kim | 273/176 H |
| 5,431,403 | 7/1995 | Pelz | 473/160 |
| 5,445,381 | 8/1995 | Van Ert | 473/160 |

*Primary Examiner*—Mark S. Graham
*Attorney, Agent, or Firm*—Nields, Lemack & Dingman

[57] ABSTRACT

Golf putting apparatus having a putting surface on which a plurality of support springs and corresponding screws are provided proximate the periphery of the putting surface for enabling the user to quickly and easily create, or selectively alter, undulations in the putting surface.

10 Claims, 5 Drawing Sheets

GOLF PUTTING APPARATUS WITH VARIABLE SURFACE

FIELD OF THE INVENTION

This invention relates to golf putting devices having a surface which can be selectively altered by the user to create undulations or variable breaking speeds in the surface.

BACKGROUND OF THE INVENTION

Golf putting devices having a selectively variable surface are well known. Numerous kinds of means for selectively varying the surface of these devices have been developed over the years. For example, U.S. Pat. Nos. 1,761,039 issued to Hazeltine and 3,727,917 issued to MacLean disclose variable contour golf putting devices with hinged panels and pegs for propping up various sections of the putting surface at the hinge joints; U.S. Pat. Nos. 3,690,673 issued to Occhipinti and 3,892,412 issued to Koo disclose variable contour golf putting devices with inflatable air sacs disposed at various locations under the putting surface; U.S. Pat. Nos. 1,582,183 issued to Maurer, 3,170,694 issued to Dolce, 4,222,568 issued to Russo and 4,790,538 issued to Gettelfinger disclose variable putting surfaces using a variety of gears, shafts, cams and levers to distort the putting surface; U.S. Pat. Nos. 3,595,581 issued to Andersen, 3,658,343 issued to Rogers and 4,247,112 issued to Del Raso disclose variable putting surfaces using a series of jacks to prop up various sections of the putting surface; U.S. Pat. Nos. 2,118,084 issued to Heinzelmann, 2,334,540 issued to Buffham, 3,601,407 issued to Lorrance, 4,743,027 issued to Simjian, 5,002,280 issued to Hines and 5,172,914 issued to Prinerano disclose variable putting surfaces which use a variety of levers and rods to push up on the underside of the putting surfaces; U.S. Pat. No. 3,871,661 issued to Korff which discloses a kidney shaped putting green under which an angled panel is swiveled to raise portions of the putting green; and U.S. Pat. No. 4,240,637 issued to Cross which discloses a coin operated putting apparatus which is tilted using a crank shaft which communicates with a threaded bolt around which a nut affixed to the putting surface is rotated thus increasing or decreasing the elevation of the putting surface. However, these designs for varying the contour of the putting surface are unwieldy, require numerous interlocking parts and are costly to manufacture and assemble. In contrast, there are a few relatively simple designs which are known. For example, U.S. Pat. No. 5,318,303 issued to Kim discloses a hinged putting surface and a canopy from which strings with hooks are hung to selectively engage and hold up the panels; U.S. Pat. 3,508,756 issued to Bedford discloses a flexible horizontal putting surface, suspended by loops under tension between vertical arms, which is contoured by raising and lowering the loops on the arms causing the surface to torque; and U.S. Pat. Nos. 4,211,417 issued to Brown and 4,988,106 issued to Coonrod disclose a putting surface which is contoured by pushing a wedge-shaped device under the bottom of the putting surface. However, these simplistic designs do not provide the user with potential surface variations adequate to recreate actual putting conditions encountered on the golfing green.

SUMMARY OF THE INVENTION

Therefore it is an object of the invention to provide a golf putting device with a selectively variable contoured surface that is inexpensive to make.

It is a further object of the invention to provide a golf putting device with a selectively variable contoured surface that can be adjusted quickly and easily.

It is a further object of the invention to provide a golf putting device comprising a reversible surface panel to enable the user to vary the speed of the putting surface.

It is a further object of the invention to provide a golf putting device with a selectively variable contoured surface capable of fine adjustment.

It is a further object of the invention to provide a golf putting device which is lightweight.

The preferred embodiment of the invention features a golf putting device having a selectively contourable putting surface over which a golf ball is putted towards a hole, comprising: a plurality of helical springs having an outside diameter; a flexible panel supported by said springs, the panel comprising a periphery, a plurality of panel bores having a diameter smaller than the diameter of the springs and provided proximate the periphery, and hole having a diameter larger than the golf ball; a frame comprising a flange provided with a plurality of flange bores having a diameter smaller that the diameter of the springs; a plurality of sockets provided in the flange bores of the flange and having an inner threaded bore and an outer diameter smaller than the diameter of the springs, said springs to be placed around the sockets which are positioned to correspond to the aforementioned panel bores; a plurality of screws having diameters matching the diameter of the socket inner threads, the screws being provided first through one panel bore then through one support spring and then into one socket inner threaded bore, rotation of any screw causing a change in the compressed state of its associated spring, which change causes variations in the relative height of the surface of the flexible panel. The bores in the panel are of a larger diameter than the penetrating screws, allowing lateral and longitudinal movement of the panel with respect to the screw as the panel contour is modified.

The golf putting device may further feature a flexible panel which is reversible and further comprises a top surface having a top surface speed and a bottom surface having a bottom surface speed that is faster or slower than the top surface speed. The flexible panel may also include an extension panel removably fixed to the flexible panel or foldable with respect thereto to selectively vary the overall length of the flexible panel.

The preferred embodiment of the golf putting device may further comprise a golf ball return comprising a gutter provided proximate the periphery and/or proximate the cup. The screws of the preferred embodiment may be a thumbscrew or may further comprise a wingnut, and the frame is preferably rigid plastic.

This invention is the result of efforts to design a golf putting device with a selectively variable contoured surface that is cost effective to make and has an adjusting mechanism that is quickly and easily manipulated by the user.

BRIEF DESCRIPTION OF THE DRAWINGS

Other objects, features and advantages will occur to those skilled in the art from the following description of a preferred embodiment and the accompanying drawings in which.

DETAILED DESCRIPTION OF THE INVENTION

Figure 1:
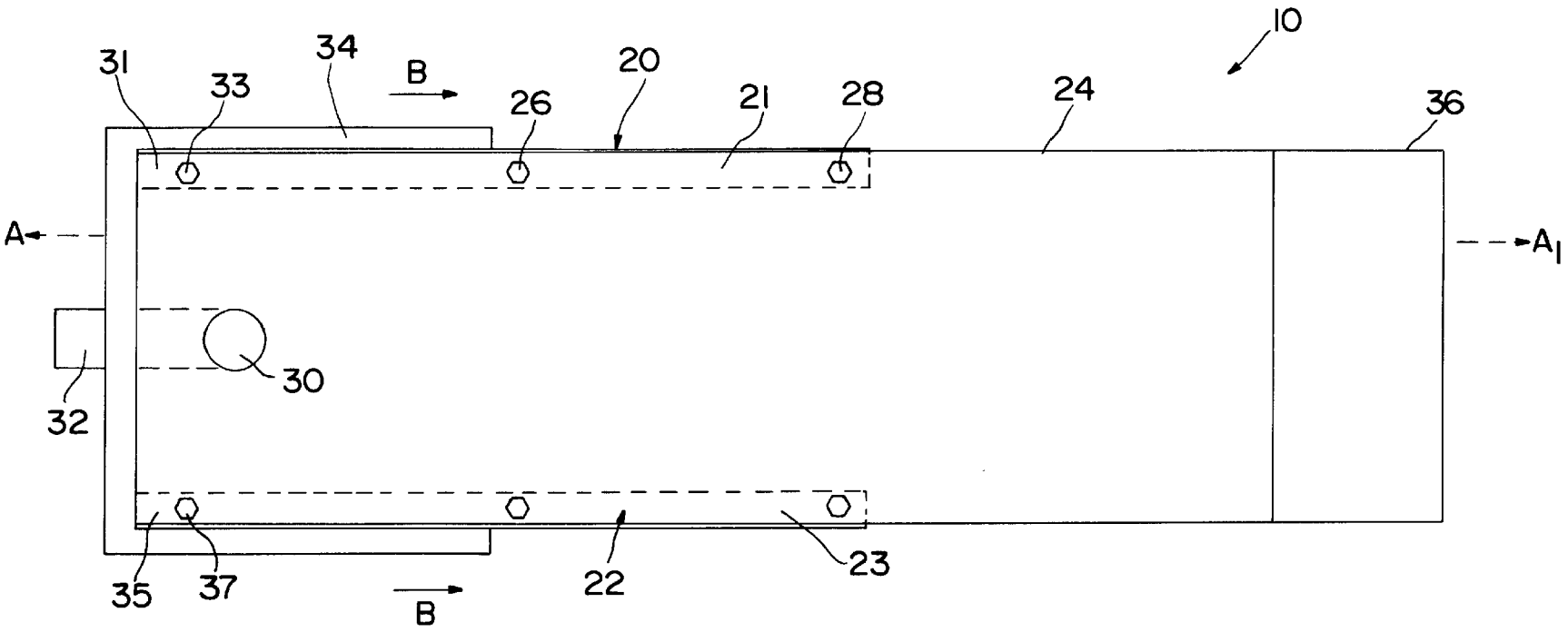
FIG. 1 is a top view of a preferred embodiment of the invention.
Figure 2:
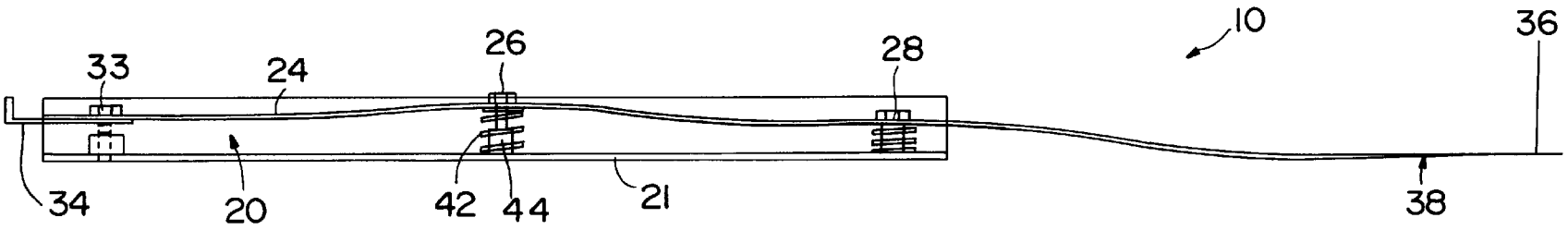
FIG. 2 is a cross-section view of the preferred embodiment shown in FIG. 1 along line A—$A_1$.

This invention features a simple golf putting device having a plurality of support springs and corresponding screws, provided proximate the periphery of the putting surface, which can be quickly and easily adjusted to create a variable undulating golf putting surface. A preferred embodiment is shown in FIGS. 1 and 2 as golf device 10. Golf device 10 may be constructed by affixing a plurality of internally threaded sockets, preferably six, e.g., socket 44 (FIG. 2) to flanges 21 and 23, preferably by affixing the sockets 44 into bores provided in flanges 21 and 23 of frame angles 20 and 22, respectively. Support springs, such as helical spring 42 (FIG. 2), have an outside diameter greater than the diameter of the threaded sockets, and greater than the diameter of bores provided in panel 24, are positioned around the sockets 44. The height of the springs 42 in their uncompressed state is greater than the height of the sockets 44, such that the springs 42 provide a flexible support system for panel 24. Panel 24 is placed so that bores on the periphery of said panel are directly over the sockets nested on the springs. Thumbscrews 26, 28, 33, 37, or the like engage matching threads of the inner bore of the sockets. The head of each thumbscrew is preferably larger in diameter than the panel bore so that the head sits on the surface of the panel 24. Alternatively or in addition, washers 40, 46 or the like (FIGS. 3A, 3B) can be used having diameters larger than the panel bore diameter to ensure that the head of the thumbscrew remains atop the surface of the panel 24. The leg of each thumbscrew is smaller in diameter than each panel bore in order to allow both lateral and longitudinal movement of the panel 24 about the leg during manipulation of the panel contour in accordance with the present invention. The difference in height between uncompressed support springs 42 and threaded sockets 44 determines the extent of spring compression, and therefore panel surface contouring, achievable by rotation or tightening or loosening of the screws. The minimum screw length should equal the spring compression plus the thickness of the panel 24 and concomitant putting surface thereon.

By using a plurality of spring/thumbscrew assemblies on opposite lateral sides of the panel 24, several advantages can be achieved. For example, the slope of the panel 24 or putting surface thereon can be varied both in the longitudinal direction (i.e., as between the golf hole 30 and the opposite end of the panel 24 from which the putter is positioned) between thumbscrews located on the same side of the panel 24 (i.e., between thumbscrews 33 and 26 and 26 and 28), and in the lateral direction, between thumbscrews oppositely located (e.g., between thumbscrews 33 and 37). For example, by tightening thumbscrew 33 relative to thumbscrew 26, a longitudinal slope of panel 24 downwardly in the direction of the golf hole 30 can be achieved. Similarly, by tightening thumbscrew 33 relative to thumbscrew 37, a lateral slope of panel 24 downwardly towards thumbscrew 33 can be achieved. From the foregoing, it immediately becomes apparent that numerous putting surface contours can be easily achieved, simulating actual putting conditions. As the number of thumbscrew/spring assemblies on each side of panel 24 is increased, the more undulations can be created per length of panel 24. Although it is preferred that the thumbscrew/spring assemblies be located such that each thumbscrew/spring assembly on one lateral side of the panel 24 has a thumbscrew/spring assembly directly opposite on the opposing lateral side of the panel 24, it is within the scope of the present invention to offset the opposing thumbscrews/spring assemblies.

Frame angles 20 and 22 are rigid, preferably L-shaped sections made of any suitable material, such as stainless steel, aluminum, or preferably rigid plastic such as plastic available commercially from Barbour Plastics of Brockton, Massachusetts under catalog no. R1208. The frame angles provide a support for a portion of the panel 24 relative to which the panel 24 can be elevated, and interconnect each screw/spring assembly on a respective side of the panel 24. The remainder of the panel 24 not supported by the frame angles is supported on the substrate (such as a floor) on which the frame angles are supported. Preferably the frame angles 20 and 22 extend more than half way from the end of panel 24 proximate the hole 30 to the opposite putting end of panel 24, thereby enabling the optimum spacing among the plurality of screw/spring assemblies. Panel 24 is a flexible board preferably made from semi-rigid Georgia Pacific ⅛" pressed hardboard. Other materials may be used to make frame angles 20 and 22 and panel 24 provided these materials comport with the objects of the invention. In particular, the panel 24 should be rigid enough so as to maintain the undulations created between lateral and opposing screw/spring assemblies, but flexible enough so that such undulations can be created. Too rigid a board will not allow sufficient differences in relative height between both laterally spaced and opposing screw/spring assemblies to be achieved. The top or putting side of panel 24 is preferably covered with a surface material having a nap resembling the surface conditions of a typical putting green. The preferred surface material is a 24 oz olefin polypropylene indoor/outdoor carpet made by General Felt Industries and is fixed to panel 24 using a suitable adhesive. To make a reversible panel 24, the bottom side of panel 24 is covered with a surface material having a nap that is substantially shorter or longer than the surface material covering the top side of panel 24 to create a surface having a surface speed which is faster or slower, respectively, than the surface speed of General Felt's 24 oz olefin polypropylene carpet. For example, billiard felt will provide a faster surface speed than the 24 oz olefin polypropylene carpet.

Golf device 10 is shown with extender panel 36 which can be removably or foldably attached to the end of panel 24 by clasp or hinge 38 so as to create a substantially smooth surface joint between extender panel 36 and panel 24. Removable or foldable extender panel 36 allows for a longer putting surface but maintains the compactness of the apparatus for easy storage and transport. Golf hole 30 is provided in panel 24, preferably centrally located in the lateral direction with respect to frame angles 20 and 22 and at or near the end of panel 24 remote from the putter as shown in FIG. 1. Golf hole 30 preferably opens into ball receptacle 32 for receiving and retaining golf balls which drop into golf hole 30. Golf hole 30 must have a diameter larger than a typical golf ball and preferably has a diameter substantially the same as the standard diameter established for holes on professional golf course. Ball gutter 34 surrounds that portion of panel 24's periphery which is proximate golf hole 30. Ball gutter 34 is fixed to frame angles 20 and 22 by also inserting screws 33 and 37 through bores in ball gutter 34 after screws 33 and 37 are inserted through panel 24 and fixed into flanges 21 and 23, respectively. Ball gutter 34 should be fixed in such a way to panel 24, or have a shape, so as to cause a golf ball, which drops into ball gutter 34, to roll in the direction of arrows B back towards the user. Ball return devices such as ball gutter 34 are well known in the art of golf putting devices and as such someone skilled in the relevant art will readily understand how to make and attach such a device to panel 24. Ball receptacle 32 may be configured to direct golf balls, which drop into golf hole 30, into ball gutter 34.

Figure 3A:
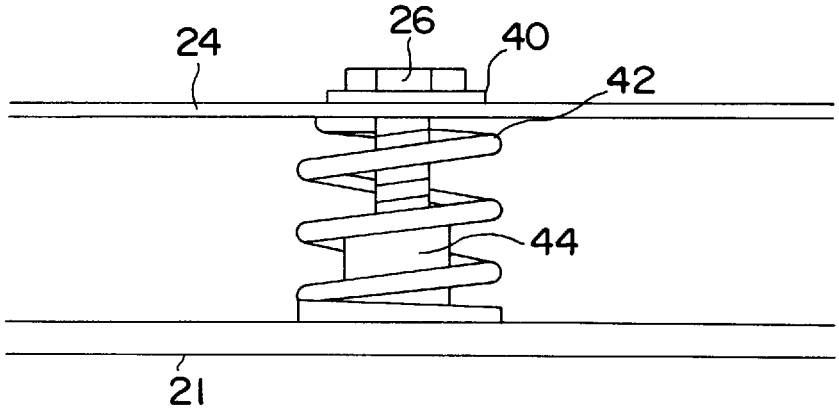
FIG. 3A is an enlarged view of screw 26 shown in FIG. 2.
Figure 3B:
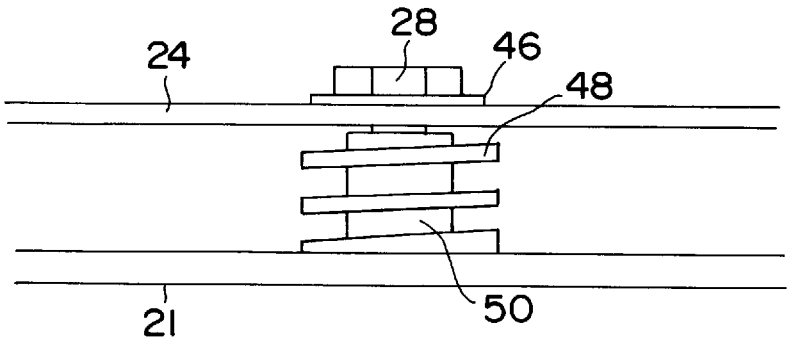
FIG. 3B is an enlarged view of screw 28 shown in FIG. 2.

FIGS. 3A and 3B are enlarged views of thumbscrews 26 and 28 assembled together with their corresponding washers, springs and sockets. FIG. 3A shows thumbscrew 26 partially engaging socket 44 so that helical spring 42 is compressed enough to provide sufficient upward pressure on the bottom side of panel 24 to counter the downward pressure exerted by thumbscrew 26 through intermediate washer 40 on the top side of panel 24, thereby tightly securing panel 24 between spring 42 and washer 40. Further tightening of thumbscrew 26 will effectively lower the height of panel 24 at the location of thumbscrew. FIG. 3B shows thumbscrew 28, together with washer 46, completely tightened down on socket 50 so that helical spring 48 is compressed to a height equal to the height of socket 50, thus the elevation of panel 24 at thumbscrew 28 is lower than the elevation of panel 24 at thumbscrew 26 as shown in FIG. 2. Likewise, if thumbscrew 28 is unscrewed, the elevation of panel 24 at the location of thumbscrew 28 will increase.

When the screw/spring/socket joint is assembled, total height of the extended screw and the socket will equal the height of the spring. The height of any socket, together with the length of its corresponding screw, will determine the extent to which the elevation of panel 24 may be increased or decreased at the point of a given socket. By tightening and untightening any screw engaging the periphery of panel 24, the elevation of panel 24 can be altered to create varying undulations in panel 24 to recreate the undulating contours encountered on a golf green. By virtue of the thumbscrew/socket/spring arrangement, the elevation of panel 24 can be finely adjusted to recreate even the subtle but difficult variations found on golf courses.

Figure 3C:
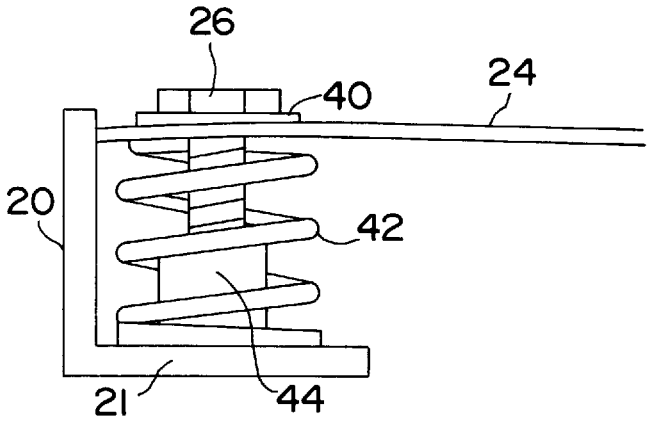
FIG. 3C is a side view of screw 26 shown in FIG. 3A.
Figure 3D:
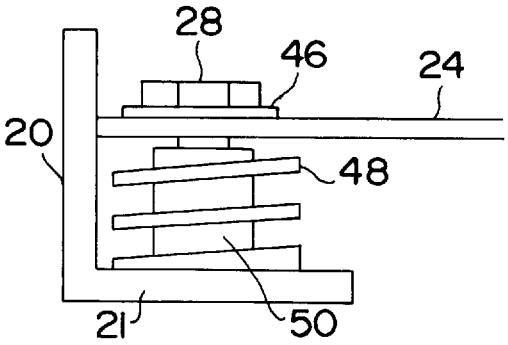
FIG. 3D is a side view of screw 28 shown in FIG. 3B.

FIGS. 3C and 3D are side views of thumbscrews 26 and 28 fully assembled as shown in FIGS. 3A and 3B, respectively. These side view show the position of sockets 44 and 50 in relation to flange 21 extending horizontally from the vertical outer wall of frame angle 20.

Figure 4A:
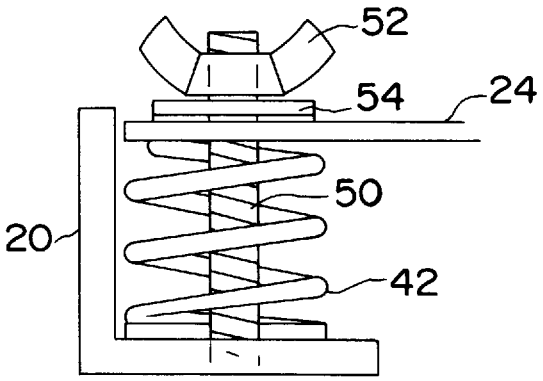
FIG. 4A is a side view of a second embodiment of a spring/screw assembly.
Figure 4B:
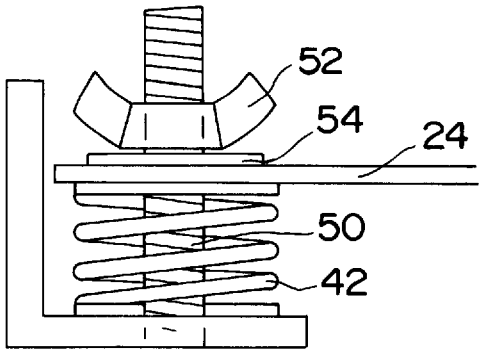
FIG. 4B is a side view of the second embodiment of a spring/screw assembly in a decompressed state.

In an alternative embodiment, sockets 44 are eliminated. Instead, a plurality of threaded screw members 50 or the like are fixed to frame angles 20 and 22 as shown in FIG. 4A and 4B. such as by a suitable adhesive or by any suitable mechanical means. Each spring 42 has an outside diameter larger than the diameter of each screw member 50, and therefore sits about each screw member 50 in a manner similar to the embodiment where the springs 42 sat about sockets 44. Panel 24 is supported by each spring 42 as shown. A wingnut 52 or the like is threaded onto each screw member 50 and secures the panel 24 against the springs 42. The wingnut 52 has a diameter larger than the bores in the panel 24 through which the screw members 50 project, so that the wingnut 52 sits on the panel 24 surface. Alternatively or in addition, washers 54 can be placed between the panel 24 and the wingnut as shown. FIG. 4B shows the spring/screw assembly in a decompressed state relative to the position shown in FIG. 4A, thereby causing a panel undulation. It will be appreciated by the skilled artisan that by "screw members", the present inventor intends to cover other suitable means capable of moveably securing the panel 24, supported on compressible spring means, to a substrate, so as to readily vary the contour of the panel 24.

In operation, the putter selectively tightens or loosens various screws along the periphery of the putting surface, thereby compressing or decompressing various springs, so as to change the slope and/or contour of the surface both laterally and longitudinally, thereby requiring that the putt of the golf ball be carried out with different speeds and directions.

Although specific features of this invention are shown in some drawings and not others, this is for convenience only as each feature may be combined with any or all of the other features in accordance with the invention.

Other embodiments will occur to those skilled in the art and are within the following claims.

What is claimed is:

1. Golf putting apparatus having a selectively variable putting surface over which a golf ball is putted toward a hole in said surface, comprising:

a rigid frame interconnecting a plurality of sockets, each socket having an inner threaded bore;

a plurality of springs, each spring being disposed about one of said plurality of sockets;

a plurality of screws, each having a head and a threaded leg, each threaded leg being adapted to engage said inner threads of one of said plurality of sockets; and a flexible panel defining said putting surface, said flexible panel being supported on said plurality of springs and movably coupled to said frame by said plurality of screws engaging said plurality of sockets, said flexible panel having a hole having a diameter larger than said golf ball.

2. The golf putting device of claim 1, wherein said flexible panel is reversible and further comprises a top having a surface adapted to impart a first frictional force on a rolling ball and a bottom having a surface adapted to impart a second frictional force on a rolling ball, said second frictional force being different from said first frictional force.

3. The golf putting device of claim 1 further comprising a golf ball return comprising a gutter provided proximate the periphery of said apparatus.

4. The golf putting device of claim 1 further comprising a golf ball return provided proximate said hole.

5. The golf putting device of claim 1 wherein said flexible panel has a length and further comprises an extension panel removably fixed to said flexible panel.

6. The golf putting device of claim 1 wherein said screw is a thumbscrew.

7. The golf putting device of claim 1 wherein said frame is plastic.

8. The golf putting device of claim 1 wherein said hole further comprises a receptacle for receiving and retaining said golf ball therein.

9. Adjustable golf putting surface apparatus, comprising:

a putting surface defined by a first end and a second end spaced from said first end and a pair of opposite sides extending between said first and second ends, each of said opposite sides having a plurality of bores;

an aperture for receiving a golf ball formed in said surface at a point remote from said first end;

a plurality of screws, each of said plurality of screws being positioned through one of said plurality of bores in said opposite sides of said putting surface;

a plurality of springs, each said spring being positioned about one of said plurality of screws and supporting said putting surface; and frame means comprising a base portion to which said plurality of screws are attached.

10. The adjustable putting surface of claim 9, wherein each of said plurality of screws in one of said pair of opposite sides directly opposes a screw in said other of said pair of opposite sides.

* * * * *